US010008163B1

(12) United States Patent
Cui et al.

(10) Patent No.: US 10,008,163 B1
(45) Date of Patent: Jun. 26, 2018

(54) DRIVER STRUCTURE FOR RGBW FOUR-COLOR PANEL

(71) Applicant: Wuhan China Star Optoelectronics Technology Co., Ltd., Wuhan (CN)

(72) Inventors: Zhufeng Cui, Wuhan (CN); Zhenzhou Xing, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 148 days.

(21) Appl. No.: 15/128,422

(22) PCT Filed: Aug. 30, 2016

(86) PCT No.: PCT/CN2016/097302

§ 371 (c)(1),
(2) Date: Sep. 22, 2016

(87) PCT Pub. No.: WO2018/028007

PCT Pub. Date: Feb. 15, 2018

(30) Foreign Application Priority Data

Aug. 10, 2016 (CN) ..... 2016 1 0651930

(51) Int. Cl.
*G09G 3/36* (2006.01)
*G09G 3/3208* (2016.01)

(52) U.S. Cl.
CPC ..... *G09G 3/3607* (2013.01); *G09G 3/3208* (2013.01); *G09G 2300/0426* (2013.01); *G09G 2300/0452* (2013.01); *G09G 2320/0247* (2013.01); *G09G 2330/021* (2013.01)

(58) Field of Classification Search
CPC ..... G06F 3/041; G06F 3/045; G01R 27/26; G02F 1/1343; H01L 27/32; G09G 3/36
See application file for complete search history.

(56) References Cited

U.S. PATENT DOCUMENTS

| | | | | |
|---|---|---|---|---|
| 7,808,463 | B2 * | 10/2010 | Kim | G09G 3/3291 345/76 |
| 7,852,311 | B2 * | 12/2010 | Hashimoto | G09G 3/3688 345/100 |
| 9,837,009 | B2 * | 12/2017 | Kim | G09G 3/20 |
| 2007/0057877 | A1 * | 3/2007 | Choi | G09G 3/3233 345/76 |
| 2017/0061872 | A1 * | 3/2017 | Zhou | G09G 3/3233 |

FOREIGN PATENT DOCUMENTS

| | | |
|---|---|---|
| CN | 105469765 A | 4/2016 |
| CN | 105679275 A | 6/2016 |

* cited by examiner

*Primary Examiner* — Pegeman Karimi
(74) *Attorney, Agent, or Firm* — Leong C. Lei

(57) ABSTRACT

The invention discloses a driver structure for RGBW four-color panel, the RBGW four-color panel comprising a plurality of sub-pixels arrange in an array, for twelve adjacent sub-pixels connected to a same scan line n, the twelve sub-pixels comprising a red sub-pixel, a green sub-pixel, a blue sub-pixel and a white sub-pixel arranged in a specific order with three repetitions, two adjacent data lines n and n+1, being connected respectively to drive the sub-pixels of the odd-rows and even-rows in the twelve sub-pixels, and the data line n and data line n+1 having opposite signal polarity. In summary, the driver structure for RGBW four-color panel of the present invention can reduce the panel power-consumption and the cost of driver IC, which enables improving flickering.

17 Claims, 7 Drawing Sheets

DRIVER STRUCTURE FOR RGBW FOUR-COLOR PANEL

BACKGROUND OF THE INVENTION

1. Field of the Invention

The present invention relates to the field of touch techniques, and in particular to a driver structure for RGBW four-color panel.

2. The Related Arts

The panel display devices, such as, liquid crystal display (LCD) device and organic light-emitting diode (OLED) display device, comprise a plurality of pixels arranged in an array, with each pixel usually comprising a red sub-pixel (R), a green sub-pixel (G) and a blue sub-pixel (B). Each sub-pixel is controlled by a gate line and a source line. The gate line is to control turning on and off of the sub-pixel, and the source line is to apply different data voltage signal to the sub-pixel to enable the sub-pixel to display different gray-scale to achieve full-color image display. Refer to FIG. 1A, which shows a schematic view of a conventional RGB three-color panel structure. The RGB three-color panel has a resolution of 1080×1920, and each pixel 11 comprises three sub-pixels, i.e., R, G, B, wherein the source driver unit is for applying a data signal to the panel.

With the increasing user environmental awareness and rapid developing trend of device thinness, the power-saving feature and the size of the battery cells become increasingly important in determining the consumption, and the power-saving smart phone becomes a selling-point. The RGBW (red, green, blue and white) four-color display technology employs white pixels to improve the panel transmittance, uses sub-pixel common algorithm to reduce the number of sub-pixels by ⅓ to reduce the generation yield rate risk at ultra-high resolution without changing the resolution, as well as reduces the backlight power-consumption by 40% while increasing the image contrast effect. Refer to FIG. 1B, which shows a schematic view of a conventional RGBW four-color panel structure. The resolution of the RGBW four-color panel is 1080×1920, with each pixel 12 comprises a red sub-pixel and a green sub-pixel, or a blue sub-pixel and a white sub-pixel. The source driver unit is for providing data signal to the panel.

The conventional RGBW four-color panel usually uses a 2-to-8 de-multiplexer (De-mux) driver structure, as shown in FIG. 2, which is a schematic view of the 2-to-8 De-mux driver structure for the conventional RGBW four-color panel. Compared to the simple 1-to-4 De-mux driver structure, the 2-to-8 De-muxe driver structure provides the advantages of reducing power-consumption under the common row reverse conditions. The upper part of FIG. 2 shows the source driver IC (D-IC), and the lower part shows the panel. The data signal of the sub-pixels W1, R2, B2, and G1 passes through the amplifier AMP1 to the panel, and the data signal of the sub-pixels W2, R1, B1, and G2 passes through the amplifier AMP2 to the panel. The conventional 2-to-8 De-mux driver structure uses two source lines to drive eight sub-pixels in total as a basic unit. As the panel manufacturing process progresses, the process gradually changes from the amorphous silicon (a-Si) to the low temperature polysilicon (LTPS) because LTPS provides high migration rate, and hence provides technique assurance for complex driver solutions.

SUMMARY OF THE INVENTION

To overcome the shortcomings of the known technique, the present invention provides a driver structure for RGBW four-color panel, to reduce the panel power-consumption and reduce the cost of driver IC.

To achieve the above object, the present invention provides a driver structure for RGBW four-color panel, the RBGW four-color panel comprising a plurality of sub-pixels arrange in an array, for twelve adjacent sub-pixels connected to a same scan line n, the twelve sub-pixels comprising a red sub-pixel, a green sub-pixel, a blue sub-pixel and a white sub-pixel arranged in a specific order with three repetitions, two adjacent data lines n and n+1, being connected respectively to drive the sub-pixels of the odd-rows and even-rows in the twelve sub-pixels, and the data line n and data line n+1 having opposite signal polarity.

According to a preferred embodiment of the present invention, the data line n is connected to drive the sub-pixels of the odd-row of the twelve sub-pixels; and the data line n+1 is connected to drive the sub-pixels of the even-row of the twelve sub-pixels.

According to a preferred embodiment of the present invention, the data line n+1 is connected to drive the sub-pixels of the odd-row of the twelve sub-pixels; and the data line n is connected to drive the sub-pixels of the even-row of the twelve sub-pixels.

According to a preferred embodiment of the present invention, the data line n has a positive signal polarity, and the data line n+1 has a negative signal polarity.

According to a preferred embodiment of the present invention, the data line n+1 has a positive signal polarity, and the data line n has a negative signal polarity.

According to a preferred embodiment of the present invention, the specific order of the sub-pixels connected to the scan line n is the same as the specific order of the sub-pixels connected to the scan line adjacent to the scan line n or separate from the scan line n by another scan line, wherein the specific order is: red sub-pixel R, green sub-pixel G, blue sub-pixel B and white sub-pixel W.

According to a preferred embodiment of the present invention, the specific order of the sub-pixels connected to the scan line n is the same as the specific order of the sub-pixels connected to the scan line separate from the scan line n by another scan line, wherein the specific order is: white sub-pixel W, blue sub-pixel B, green sub-pixel G and red sub-pixel R; the specific order of the sub-pixels connected to the scan line adjacent to the scan line n is: red sub-pixel R, green sub-pixel G, blue sub-pixel B and white sub-pixel W.

According to a preferred embodiment of the present invention, the specific order of the sub-pixels connected to the scan line n is the same as the specific order of the sub-pixels connected to the scan line separate from the scan line n by another scan line, wherein the specific order is: white sub-pixel W, red sub-pixel R, green sub-pixel G and blue sub-pixel B; the specific order of the sub-pixels connected to the scan line adjacent to the scan line n is: red sub-pixel R, green sub-pixel G, blue sub-pixel B and white sub-pixel W.

According to a preferred embodiment of the present invention, the specific order of the sub-pixels connected to the scan line n is the same as the specific order of the sub-pixels connected to the scan line separate from the scan line n by another scan line, wherein the specific order is: red sub-pixel R, white sub-pixel W, green sub-pixel G and blue sub-pixel B; the specific order of the sub-pixels connected to the scan line adjacent to the scan line n is: red sub-pixel R, green sub-pixel G, blue sub-pixel B and white sub-pixel W.

According to a preferred embodiment of the present invention, the RGBW four-color panel is a low temperature polysilicon (LTPS) panel.

Another object of the present invention is to provide a driver structure for RGBW four-color panel, the RBGW four-color panel comprising a plurality of sub-pixels arrange in an array, for twelve adjacent sub-pixels connected to a same scan line n, the twelve sub-pixels comprising a red sub-pixel, a green sub-pixel, a blue sub-pixel and a white sub-pixel arranged in a specific order with three repetitions, two adjacent data lines n and n+1, being connected respectively to drive the sub-pixels of the odd-rows and even-rows in the twelve sub-pixels, and the data line n and data line n+1 having opposite signal polarity; wherein the RGBW four-color panel being a low temperature polysilicon (LTPS) panel; wherein the data line n being connected to drive the sub-pixels of the odd-row of the twelve sub-pixels; and the data line n+1 being connected to drive the sub-pixels of the even-row of the twelve sub-pixels.

In summary, the driver structure for RGBW four-color panel of the present invention can reduce the panel power-consumption and the cost of driver IC, which enables improving flickering.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

As aforementioned, the present invention is to provide a capacitive touch unit able to reduce the visual difference perceptible to the human eye, and a capacitive touch screen comprising the capacitive touch unit. The capacitive touch unit comprises: a sensing electrode, connected to a control unit through a sensing electrode lead; and a plurality of scan electrodes, disposed at two sides of the sensing electrode; the scan electrode being connected to the control unit through a scan electrode lead, and the scan electrodes and the sensing electrode being coplanar; wherein the sensing electrode comprising a plurality of identical sensing electrode units, the plurality of sensing electrode units being arranged regularly along a same direction, the plurality of sensing electrode units being electrically connected; each scan electrode comprising a plurality of identical scan electrode units, the plurality of scan electrode units being arranged regularly along a same direction and the direction being the same as the sensing electrode units, and the plurality of scan electrode units being electrically connected.

In the aforementioned capacitive touch unit, the sensing electrode and the scan electrode are divided into a plurality of sensing electrode units and scan electrode units of the same shape, and the sensing electrode units and scan electrode units are coplanar and have the same arrangement direction, so as to achieve the object of reducing the visual perceptibility to human eye and solve the visual difference between the sensing electrode and scan electrode array.

The following describes the invention in details with drawings and embodiments.

Figure 1A:
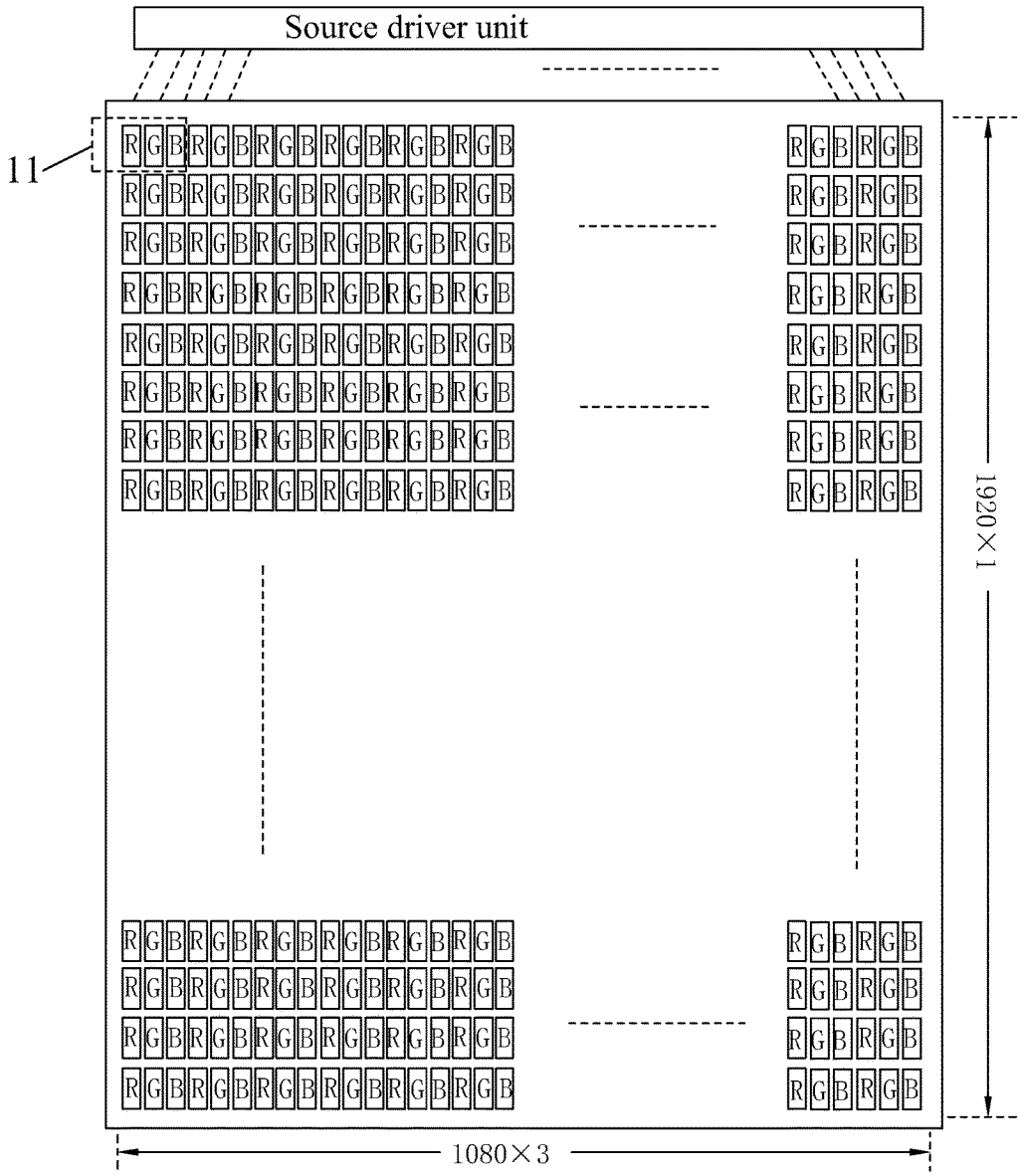
FIG. 1A is a schematic view showing the structure of a conventional RGB three-color panel.
Figure 1B:
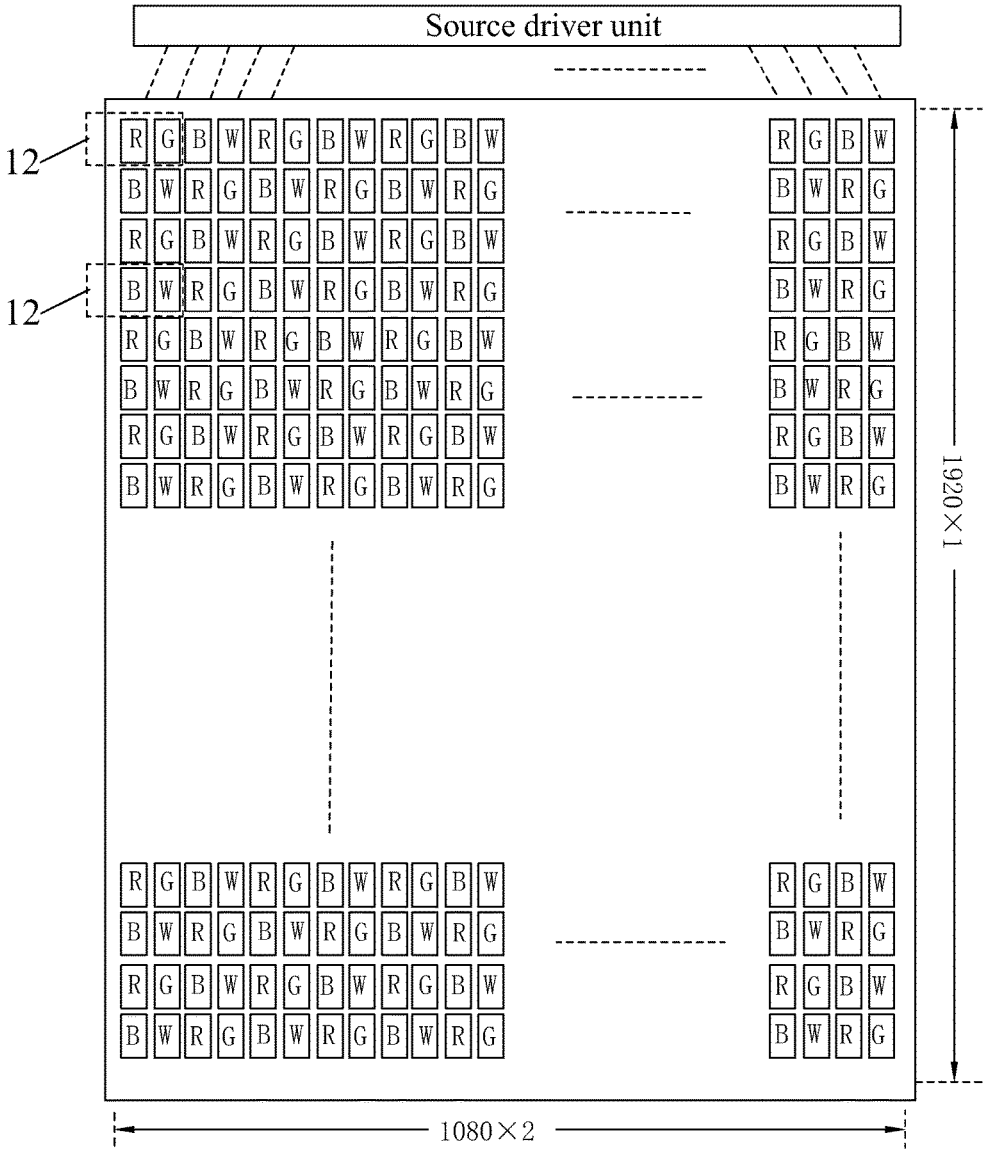
FIG. 1B is a schematic view showing the structure of a conventional RGBW four-color panel.
Figure 2:
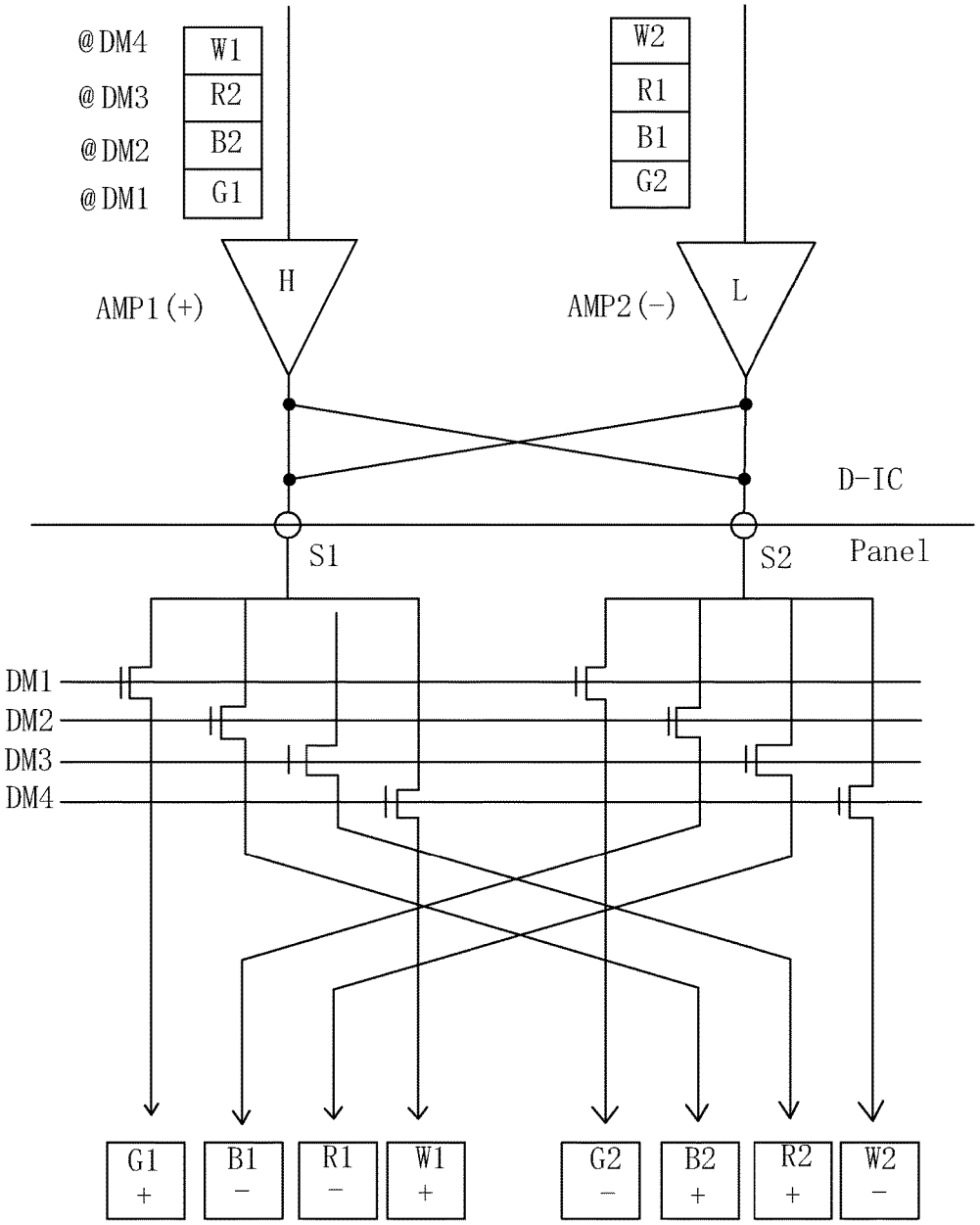
FIG. 2 is a schematic view showing the structure of a conventional 2-to-8 De-mux driver for RGBW four-color panel.
Figure 3:
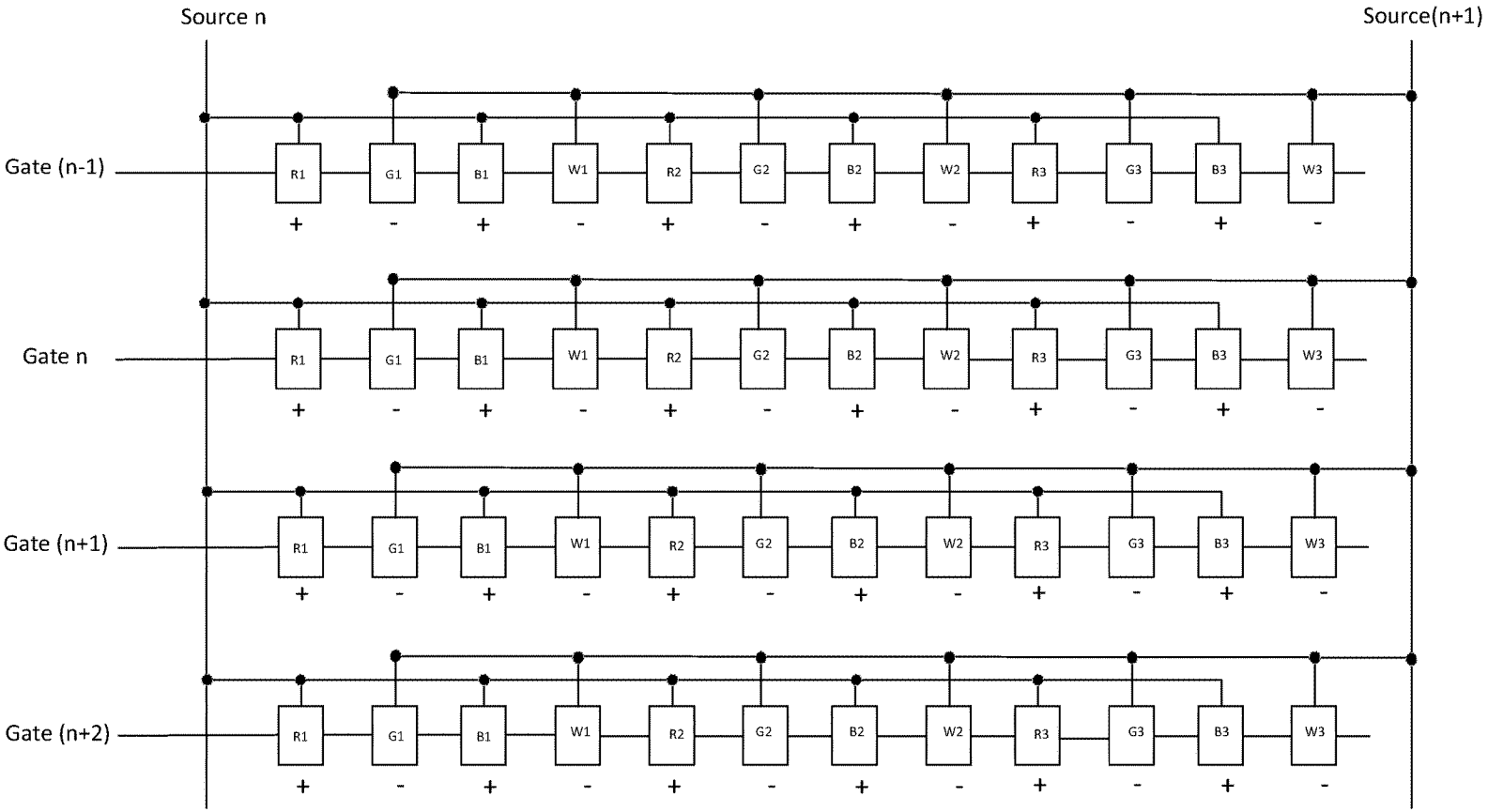
FIG. 3 is a schematic view showing the structure of a first embodiment of the driver structure for RGBW four-color panel provided by the present invention.

FIG. 3 shows the structure of a first embodiment of the driver structure for RGBW four-color panel provided by the present invention. The sub-pixels of the RGBW four-color panel are arranged in an array. For the twelve adjacent sub-pixels R1, G1, B1, W1, R2, G2, B2, W2, R3, G3, B3, and W3 connected to a same scan line n, the twelve sub-pixels comprises a red sub-pixel R, a green sub-pixel G, a blue sub-pixel B and a white sub-pixel W arranged in a specific order of R, G, B, W with three repetitions. The two adjacent data lines n and n+1 are connected respectively to drive the sub-pixels of the odd-rows and even-rows in the twelve sub-pixels. The data line n drives the odd-rows and the data line n+1 drives the even-rows. The data line n and data line n+1 have opposite signal polarity. The data line n is positive, and the data line n+1 is negative. The sub-pixel arrangement orders for scan line n, the adjacent scan lines n−1, n+1, and the scan line n+2, which is separate from the scan line n by scan line n+1, are all in the order of R, G, B, and W.

The present invention provides a novel driver structure for the known 2-ti-8 De-mux driver structure for the RGBW four-color panel, i.e., the 2-to-12 De-mux driver structure for the RGBW four-color panel of the present invention. The 2-to-12 De-mux driver structure for the RGBW four-color panel of the present invention uses two data line (i.e., also called source lines) to drive 12 sub-pixels as a basic unit. Compared to the known 2-to-8 De-mux driver structure, the present invention can reduce the number of data lines without changing the resolution. Take full high definition (FHD) as example, the number of data lines is reduced from 1080*2/4=540 to 1080*2/6=360, i.e., reduction by ⅓. As such, the areas used by the data lines and the digital-analog-converter (DAC) module in the driver IC is also reduced, resulting in a smaller-size IC to reduce the cost of driver IC. Moreover, the reduction in the number of data line operational amplifiers (OP) and DAC modules also reduces the power-consumption. As compared to the conventional 2-to-8 De-mux driver structure, the polarity inversion of the present invention is a true row reverse, and therefore has a smaller flicker value. The LTPS provides a higher migration rate, and can provide technical assurance of the driver solution of the present invention.

The present invention realizes:

(1) reduce the power consumption of the DAC and source OP module, so as to reduce the power consumption of the RGBW four-color panel.

(2) reduce the number of data lines (i.e., source lines) and DAc area, so as to reduce the cost of driver IC.

(3) true row reverse driving mechanism, facilitating flickering improvement.

The present invention also provides a plurality of R/G/B/W arrangement orders; therefore, any 2-to-12 De-mux driver structure with other arrangement order are also within the scope of the present invention.

Figure 4:
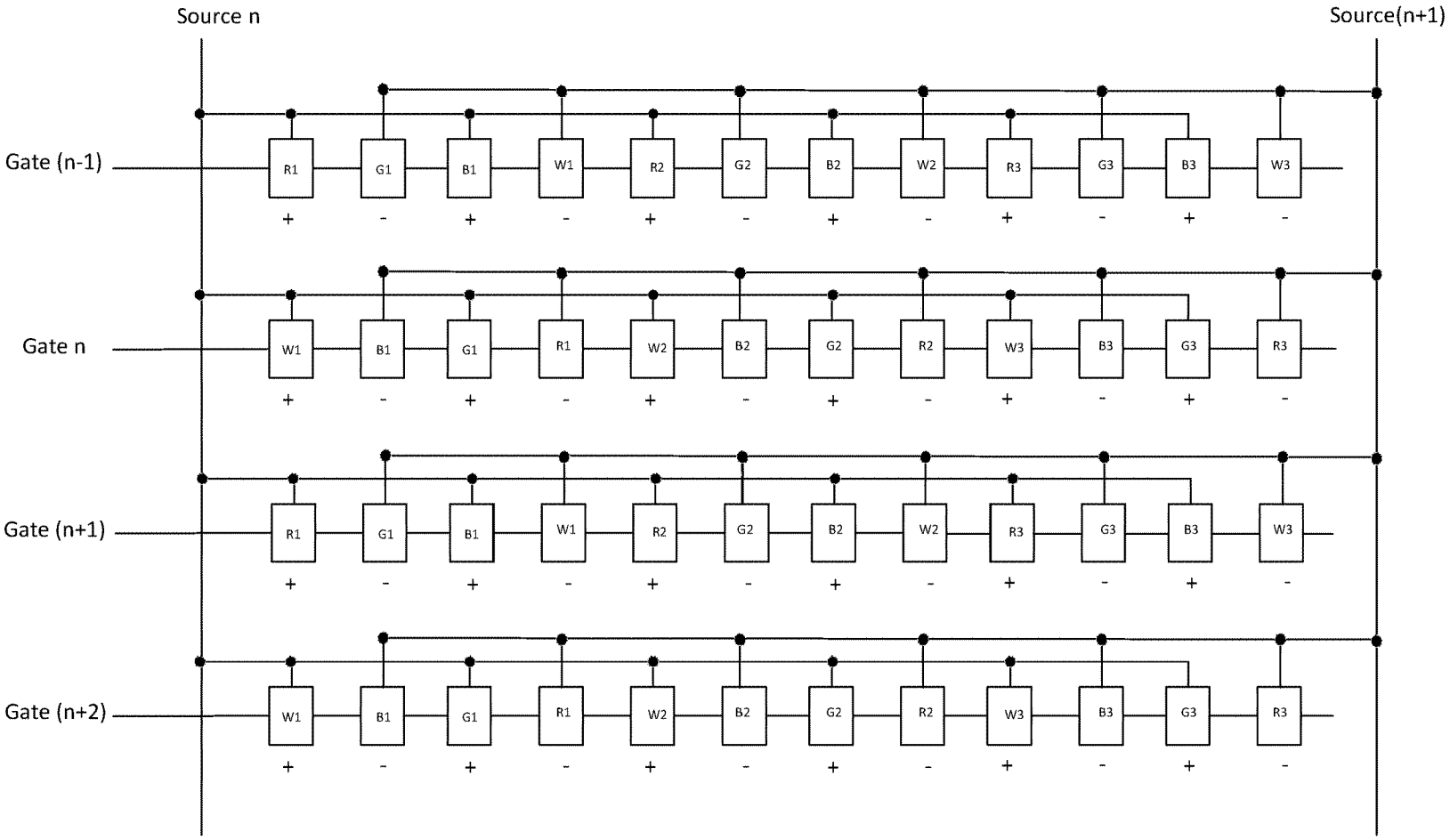
FIG. 4 is a schematic view showing the structure of a second embodiment of the driver structure for RGBW four-color panel provided by the present invention.

Refer to FIG. 4, which is a schematic view showing the structure of a second embodiment of the driver structure for RGBW four-color panel provided by the present invention; wherein the sub-pixel arrangement order for the scan line n and the scan line separate from scan line n by another scan line is: W, B, G, and R; while the arrangement order for the adjacent scan line is: R, G, B, and W.

Figure 5:
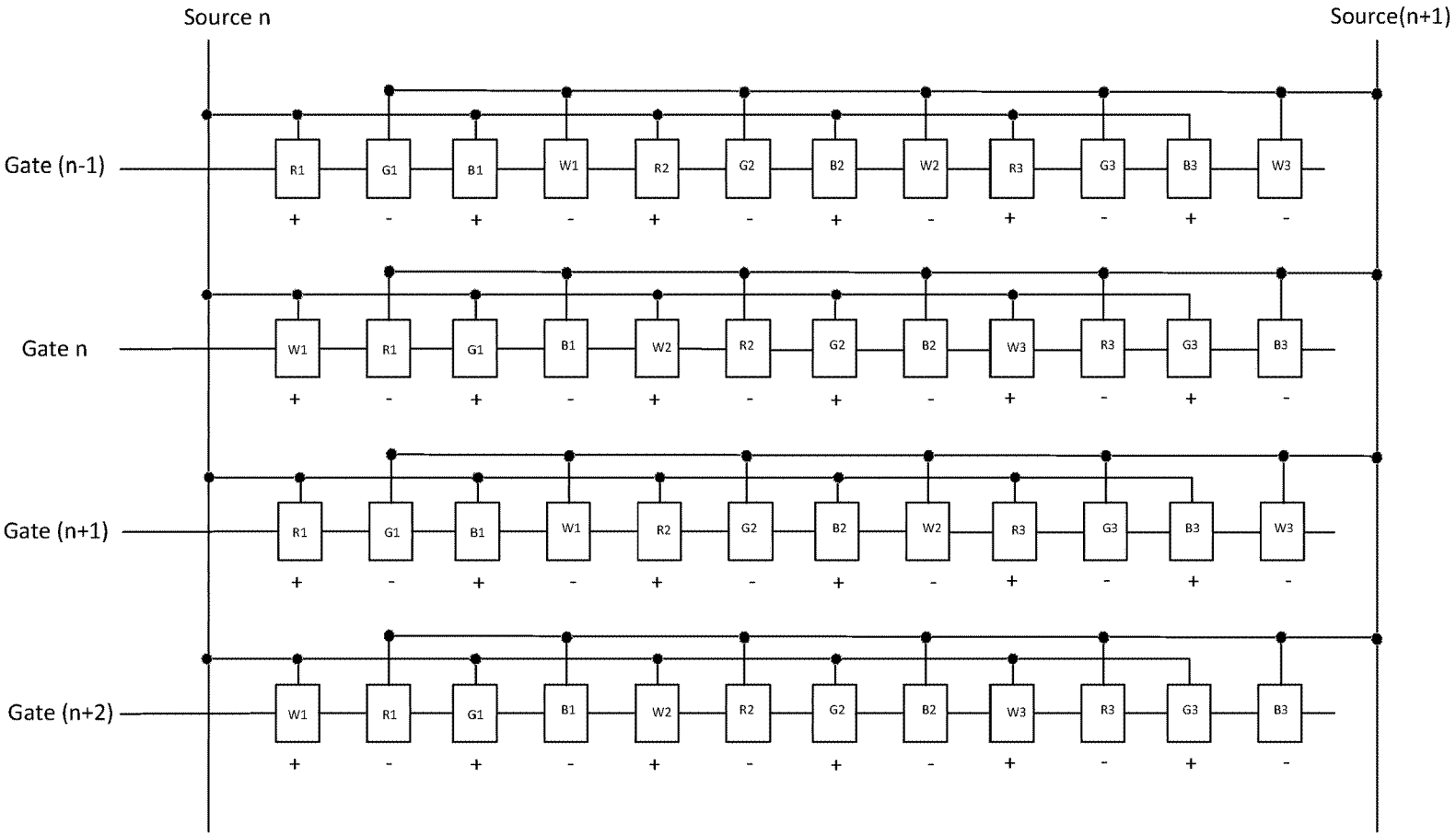
FIG. 5 is a schematic view showing the structure of a third embodiment of the driver structure for RGBW four-color panel provided by the present invention.

Refer to FIG. 5, which is a schematic view showing the structure of a third embodiment of the driver structure for RGBW four-color panel provided by the present invention; wherein the sub-pixel arrangement order for the scan line n and the scan line separate from scan line n by another scan line is: W, R, G, and B; while the arrangement order for the adjacent scan line is: R, G, B, and W.

Figure 6:
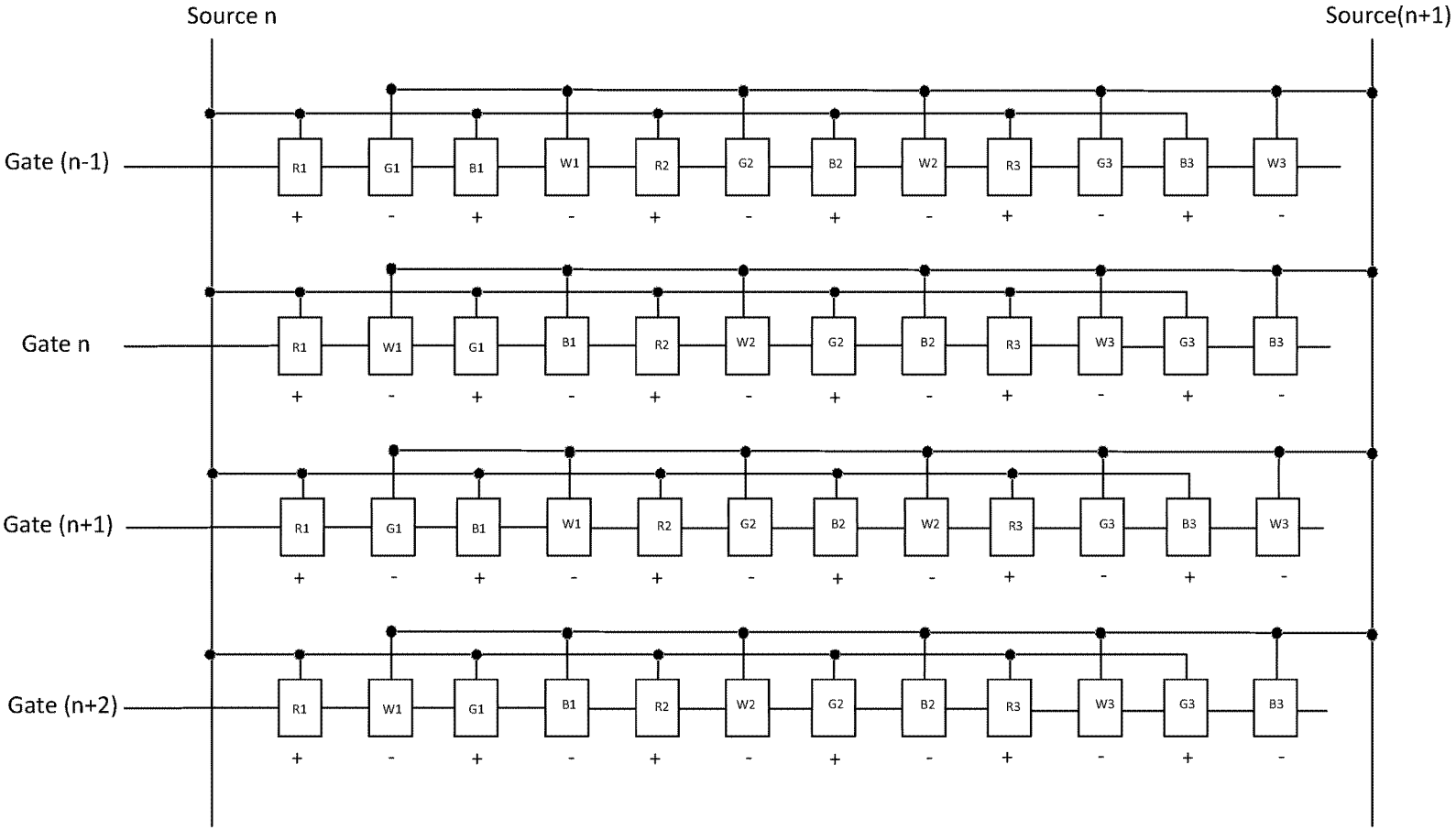
FIG. 6 is a schematic view showing the structure of a fourth embodiment of the driver structure for RGBW four-color panel provided by the present invention.

Refer to FIG. 6, which is a schematic view showing the structure of a fourth embodiment of the driver structure for RGBW four-color panel provided by the present invention; wherein the sub-pixel arrangement order for the scan line n and the scan line separate from scan line n by another scan line is: R, W, G, and B; while the arrangement order for the adjacent scan line is: R, G, B, and W.

In the instant embodiment, the capacitive touch unit 10 comprises the following structure, as shown in FIG. 4: a sensing electrode 200, connected to a control unit (not shown) through a sensing electrode lead 2003; and a plurality of scan electrodes 300, disposed at two sides of the sensing electrode 200. The instant embodiment uses an exemplar with two scan electrodes 300 disposed on each side. The scan electrodes 300 are connected to the control unit through a scan electrode lead 3003, and the scan electrodes 300 and the sensing electrode 200 are coplanar.

In summary, the driver structure for RGBW four-color panel of the present invention can reduce the panel power-consumption and the cost of driver IC, which enables improving flickering.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A driver structure for RGBW four-color panel, the RBGW four-color panel comprising a plurality of sub-pixels arrange in an array, for twelve adjacent sub-pixels connected to a same scan line n, the twelve sub-pixels comprising a red sub-pixel, a green sub-pixel, a blue sub-pixel and a white sub-pixel arranged in a specific order with three repetitions, two adjacent data lines n and n+1, being connected respectively to drive the sub-pixels of the odd-rows and even-rows in the twelve sub-pixels, and the data line n and data line n+1 having opposite signal polarity.

2. The driver structure for RGBW four-color panel as claimed in claim 1, wherein the data line n is connected to drive the sub-pixels of the odd-row of the twelve sub-pixels; and the data line n+1 is connected to drive the sub-pixels of the even-row of the twelve sub-pixels.

3. The driver structure for RGBW four-color panel as claimed in claim 1, wherein the data line n+1 is connected to drive the sub-pixels of the odd-row of the twelve sub-pixels; and the data line n is connected to drive the sub-pixels of the even-row of the twelve sub-pixels.

4. The driver structure for RGBW four-color panel as claimed in claim 1, wherein the data line n has a positive signal polarity, and the data line n+1 has a negative signal polarity.

5. The driver structure for RGBW four-color panel as claimed in claim 1, wherein the data line n+1 has a positive signal polarity, and the data line n has a negative signal polarity.

6. The driver structure for RGBW four-color panel as claimed in claim 1, wherein the specific order of the sub-pixels connected to the scan line n is the same as the specific order of the sub-pixels connected to the scan line adjacent to the scan line n or separate from the scan line n by another scan line, wherein the specific order is: red sub-pixel R, green sub-pixel G, blue sub-pixel B and white sub-pixel W.

7. The driver structure for RGBW four-color panel as claimed in claim 1, wherein the specific order of the sub-pixels connected to the scan line n is the same as the specific order of the sub-pixels connected to the scan line separate from the scan line n by another scan line, wherein the specific order is: white sub-pixel W, blue sub-pixel B, green sub-pixel G and red sub-pixel R; the specific order of the sub-pixels connected to the scan line adjacent to the scan line n is: red sub-pixel R, green sub-pixel G, blue sub-pixel B and white sub-pixel W.

8. The driver structure for RGBW four-color panel as claimed in claim 1, wherein the specific order of the sub-pixels connected to the scan line n is the same as the specific order of the sub-pixels connected to the scan line separate from the scan line n by another scan line, wherein the specific order is: white sub-pixel W, red sub-pixel R, green sub-pixel G and blue sub-pixel B; the specific order of the sub-pixels connected to the scan line adjacent to the scan line n is: red sub-pixel R, green sub-pixel G, blue sub-pixel B and white sub-pixel W.

9. The driver structure for RGBW four-color panel as claimed in claim 1, wherein the specific order of the sub-pixels connected to the scan line n is the same as the specific order of the sub-pixels connected to the scan line separate from the scan line n by another scan line, wherein the specific order is: red sub-pixel R, white sub-pixel W, green sub-pixel G and blue sub-pixel B; the specific order of the sub-pixels connected to the scan line adjacent to the scan line n is: red sub-pixel R, green sub-pixel G, blue sub-pixel B and white sub-pixel W.

10. The driver structure for RGBW four-color panel as claimed in claim 1, wherein the RGBW four-color panel is a low temperature polysilicon (LTPS) panel.

11. A driver structure for RGBW four-color panel, the RBGW four-color panel comprising a plurality of sub-pixels arrange in an array, for twelve adjacent sub-pixels connected to a same scan line n, the twelve sub-pixels comprising a red sub-pixel, a green sub-pixel, a blue sub-pixel and a white sub-pixel arranged in a specific order with three repetitions, two adjacent data lines n and n+1, being connected respectively to drive the sub-pixels of the odd-rows and even-rows in the twelve sub-pixels, and the data line n and data line n+1 having opposite signal polarity;

wherein the RGBW four-color panel is a low temperature polysilicon (LTPS) panel;

wherein the data line n is connected to drive the sub-pixels of the odd-row of the twelve sub-pixels; and the data line n+1 is connected to drive the sub-pixels of the even-row of the twelve sub-pixels.

12. The driver structure for RGBW four-color panel as claimed in claim 11, wherein the data line n has a positive signal polarity, and the data line n+1 has a negative signal polarity.

13. The driver structure for RGBW four-color panel as claimed in claim 11, wherein the data line n+1 has a positive signal polarity, and the data line n has a negative signal polarity.

14. The driver structure for RGBW four-color panel as claimed in claim 11, wherein the specific order of the sub-pixels connected to the scan line n is the same as the specific order of the sub-pixels connected to the scan line adjacent to the scan line n or separate from the scan line n by another scan line, wherein the specific order is: red sub-pixel R, green sub-pixel G, blue sub-pixel B and white sub-pixel W.

15. The driver structure for RGBW four-color panel as claimed in claim 11, wherein the specific order of the sub-pixels connected to the scan line n is the same as the specific order of the sub-pixels connected to the scan line separate from the scan line n by another scan line, wherein the specific order is: white sub-pixel W, blue sub-pixel B, green sub-pixel G and red sub-pixel R; the specific order of the sub-pixels connected to the scan line adjacent to the scan line n is: red sub-pixel R, green sub-pixel G, blue sub-pixel B and white sub-pixel W.

16. The driver structure for RGBW four-color panel as claimed in claim 11, wherein the specific order of the sub-pixels connected to the scan line n is the same as the specific order of the sub-pixels connected to the scan line separate from the scan line n by another scan line, wherein the specific order is: white sub-pixel W, red sub-pixel R, green sub-pixel G and blue sub-pixel B; the specific order of the sub-pixels connected to the scan line adjacent to the scan line n is: red sub-pixel R, green sub-pixel G, blue sub-pixel B and white sub-pixel W.

17. The driver structure for RGBW four-color panel as claimed in claim 11, wherein the specific order of the sub-pixels connected to the scan line n is the same as the specific order of the sub-pixels connected to the scan line separate from the scan line n by another scan line, wherein the specific order is: red sub-pixel R, white sub-pixel W, green sub-pixel G and blue sub-pixel B; the specific order of the sub-pixels connected to the scan line adjacent to the scan line n is: red sub-pixel R, green sub-pixel G, blue sub-pixel B and white sub-pixel W.

* * * * *